US008104559B2

(12) United States Patent
Kisse

(10) Patent No.: US 8,104,559 B2
(45) Date of Patent: Jan. 31, 2012

(54) MULTIPLE AIR FLOW PATHS USING SINGLE AXIAL FAN

(75) Inventor: Brandon Kisse, Kindred, ND (US)

(73) Assignee: Clark Equipment Company, West Fargo, ND (US)

( * ) Notice: Subject to any disclaimer, the term of this patent is extended or adjusted under 35 U.S.C. 154(b) by 679 days.

(21) Appl. No.: 12/234,838

(22) Filed: Sep. 22, 2008

(65) Prior Publication Data

US 2010/0071870 A1 Mar. 25, 2010

(51) Int. Cl.

| | |
|---|---|
| ***B60K 11/00*** | (2006.01) |
| *B60K 11/02* | (2006.01) |
| *B60K 11/04* | (2006.01) |
| *B60K 11/06* | (2006.01) |
| *B60K 11/08* | (2006.01) |

(52) U.S. Cl. ..... 180/68.1

(58) Field of Classification Search ..... 180/68.1, 180/68.2, 68.4, 68.6

See application file for complete search history.

(56) References Cited

U.S. PATENT DOCUMENTS

| | | | | |
|---|---|---|---|---|
| 2,061,800 | A | 11/1936 | Huston | 62/24 |
| 2,595,175 | A | 4/1952 | Sonderegger | 123/41.48 |
| 3,096,938 | A | 7/1963 | Cole et al. | 237/12.3 |
| 3,236,215 | A | 2/1966 | Eck et al. | 123/41.05 |
| 3,669,203 | A | 6/1972 | Honda | 180/54 |
| 4,204,486 | A | 5/1980 | Nakagawa et al. | 123/41.6 |
| 4,535,868 | A | 8/1985 | Mather et al. | 180/297 |
| 4,815,550 | A | 3/1989 | Mather et al. | 180/68.1 |
| 5,269,264 | A | 12/1993 | Weinhold | |
| 5,269,265 | A | 12/1993 | Pretzsch et al. | 123/41.56 |
| 6,257,359 | B1 | 7/2001 | Granlund et al. | 180/68.1 |
| 6,390,217 | B1 * | 5/2002 | O'Brien et al. | 180/68.6 |
| 6,405,690 | B1 | 6/2002 | Eder | 123/41.56 |
| 6,751,946 | B2 | 6/2004 | Li | 60/269 |
| 6,889,635 | B2 | 5/2005 | Geisheker et al. | 123/41.65 |
| 2005/0023057 | A1 * | 2/2005 | Maeda et al. | 180/68.1 |
| 2006/0185628 | A1 | 8/2006 | Akaike et al. | 123/41.65 |
| 2006/0228237 | A1 | 10/2006 | Winkler | 417/423.1 |
| 2008/0108032 | A1 | 5/2008 | Tuhy et al. | |

FOREIGN PATENT DOCUMENTS

| | | |
|---|---|---|
| EP | 0 535 255 | 4/1993 |
| EP | 1 486 650 | 12/2004 |

OTHER PUBLICATIONS

Written Opinion and International Search Report for PCT/US2009/056947, dated Feb. 25, 2010.

* cited by examiner

*Primary Examiner* — J. Allen Shriver, II
*Assistant Examiner* — Bryan Evans
(74) *Attorney, Agent, or Firm* — John D. Veldhuis-Kroeze; Westman, Champlin & Kelly, P.A.

(57) ABSTRACT

A cooling system for a compact vehicle such as a compact loader having an engine and an engine compartment, includes a single axial flow fan that is surrounded by a shroud and has a high pressure side and a low pressure side. Air flow generated by the fan is used for cooling components of the compact vehicle and exhausting heated air from a second shroud. Auxiliary openings are provided between the engine compartment and the shrouds to provide air flow between the engine compartment and one or both of the shrouds when the fan is rotating. The motor driving the fan is reversible.

12 Claims, 5 Drawing Sheets

MULTIPLE AIR FLOW PATHS USING SINGLE AXIAL FAN

BACKGROUND OF THE DISCLOSURE

The present disclosure relates to a cooling air control system for a compact work vehicle such as a loader, which utilizes a single, axial flow fan for providing cooling air for engine components, and which has the ability to direct flow through multiple air flow paths.

There are air handling systems for engines that have been advanced, which utilize flow directing openings to cool engine compartments, but which rely upon radial fans. An example is U.S. Pat. No. 6,257,359. Another prior patent showing an air handling system in a skid steer loader is U.S. Pat. No. 4,815,550. However, these patents do not use single, easily controlled, axial flow fans for the air flow systems.

SUMMARY OF THE DISCLOSURE

This disclosure relates to an engine cooling system for a compact work vehicle, such as a compact loader, that is arranged for directing air to or from an engine compartment, as well as directing air across components that require cooling. A single axial fan is driven with a suitable motor, and the fan blades are mounted within a surrounding shroud. The shroud has open ends so air can enter and exit the shroud when the fan is driven. A second shroud or housing, as shown, receives air from a high pressure side of the axial fan, when the fan is rotating in a first direction to force air into the second shroud and out through multiple openings as shown, in directions that are substantially perpendicular to the rotational axis of the fan. In another aspect, reversing the fan motor so the fan blades rotate in a second direction creates a lower than atmospheric pressure in the second shroud so that air is then drawn inward into the second shroud and exited in the opposite direction from the fan.

DETAILED DESCRIPTION OF ILLUSTRATIVE EMBODIMENTS

Figure 1:
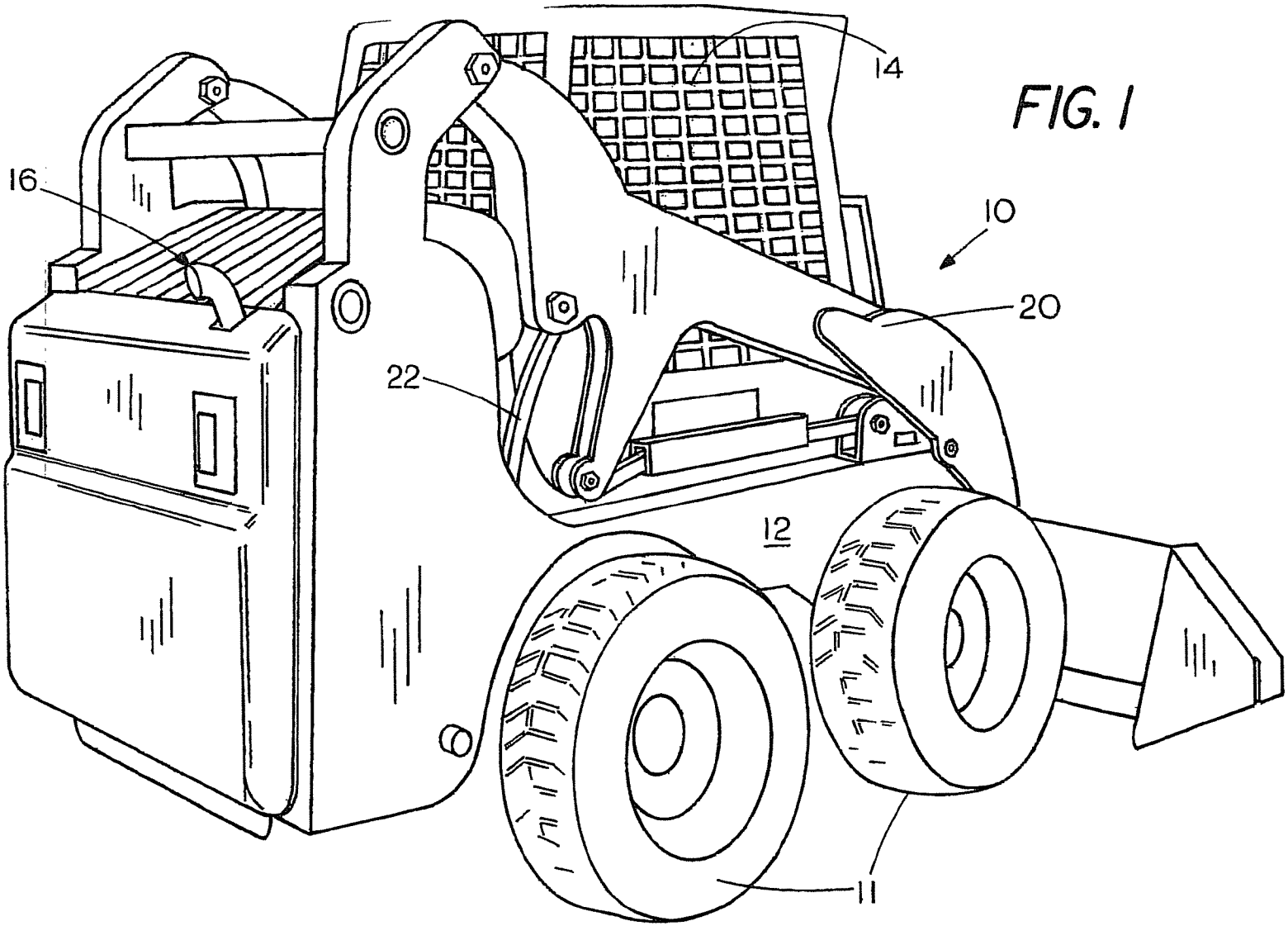
FIG. 1 is a general representation of a typical compact loader with which an air cooling system of the present disclosure.
Figure 4:
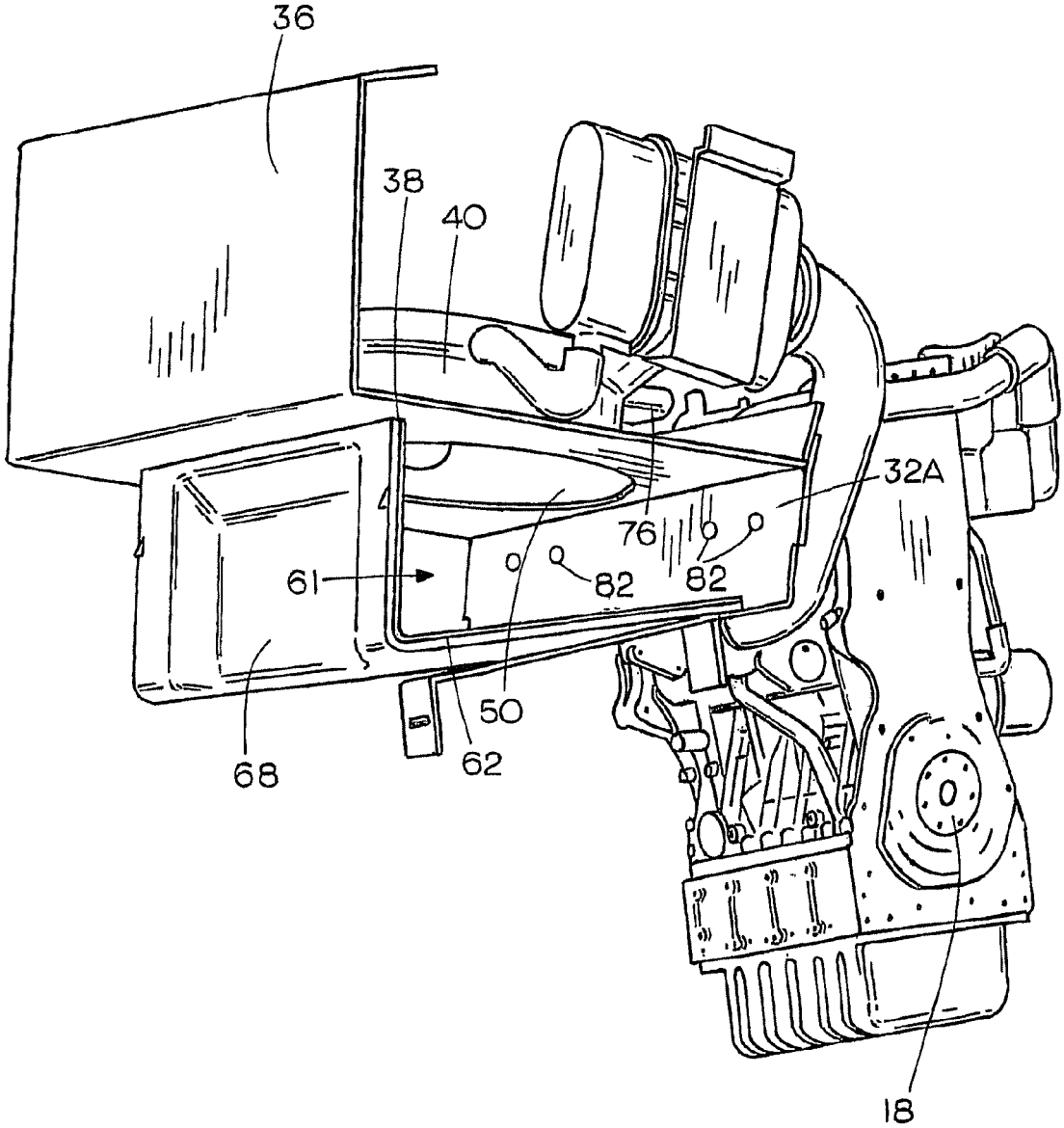
FIG. 4 is a schematic front and lower perspective view of a shroud system utilized with the present disclosure.
Figure 5:
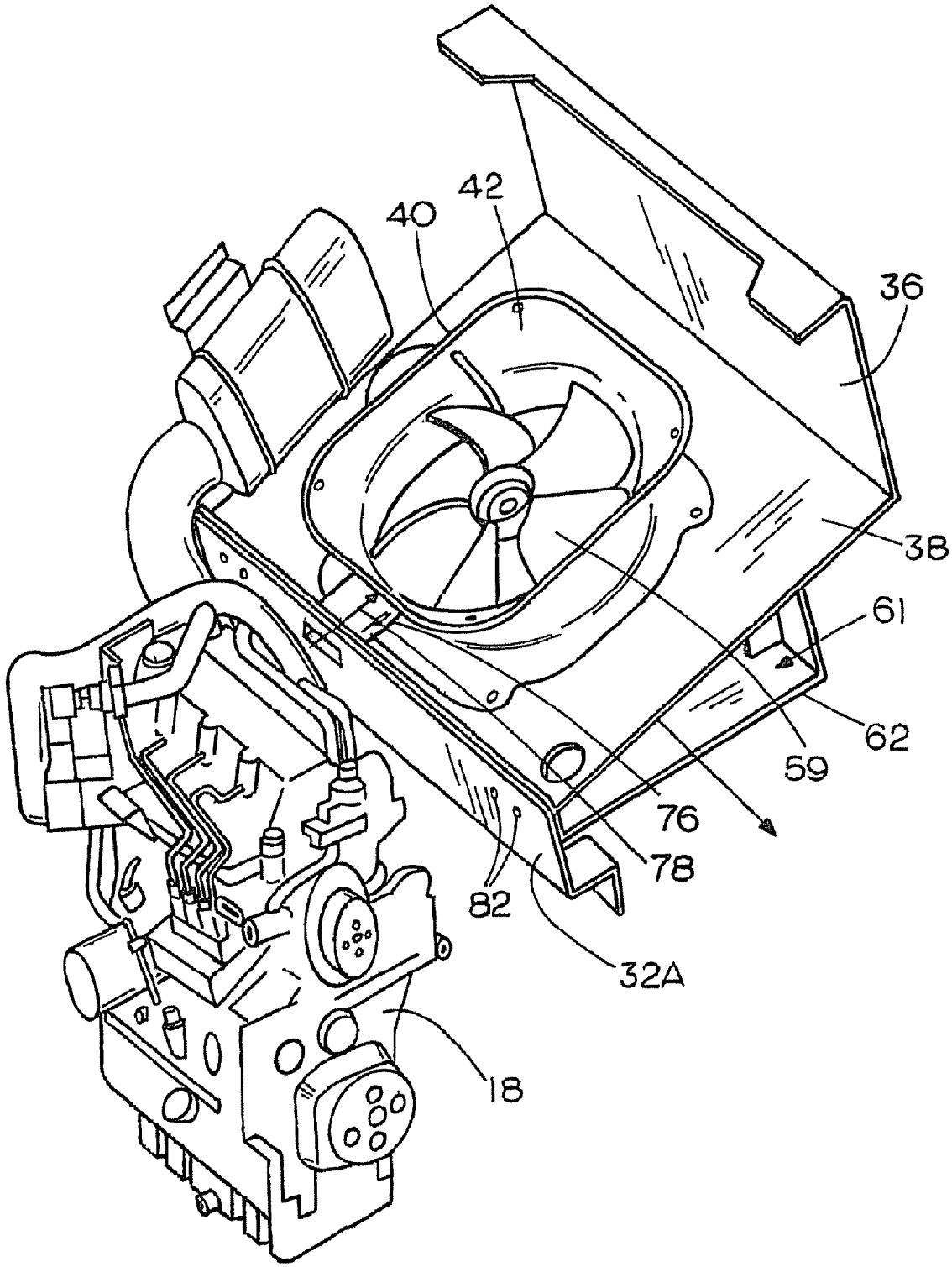
FIG. 5 is a schematic perspective top view taken from an opposite side from FIG. 4 of the shroud and fan utilized with the present disclosure.

The compact work vehicle as shown a loader indicated generally at 10 in FIG. 1, has drive wheels 11, mounted on a frame 12 of the loader. The drive wheels 11 are driven to move the loader in a normal manner. An operator's cab 14 is located at a forward end of the loader, and a rear engine compartment indicated in the area shown at 16, houses an engine 18 (see FIGS. 2, 4 and 5). The engine can be either air cooled or liquid cooled, and in the present device, a liquid cooled engine is shown. The compact loader includes lift arms 20 that are raised and lowered, with suitable hydraulic cylinders 22, in a desired path. The engine 18 and a hydrostatic pump package are used for providing hydraulic fluid under pressure to power ground drive motors and other hydraulic components.

Overall length is an important factor in compact work vehicles, such as compact loaders, and thus the overall space for mounting components is limited. It is important to use minimum space for cooling components such as the engine radiator, hydraulic oil cooler, and if installed, an air conditioner condenser and/or an intercooler or charge air cooler for cooling engine combustion air. Providing cooling air effectively for engine compartment components is desired.

The present disclosure incorporates a single axial fan that can be driven with a suitable motor, for example a hydraulic motor or an electric motor and which can be mounted in a compact space, which can (if desired) be reversed, and which includes ducts and ports for providing cooling air in multiple flow paths.

Figure 2:
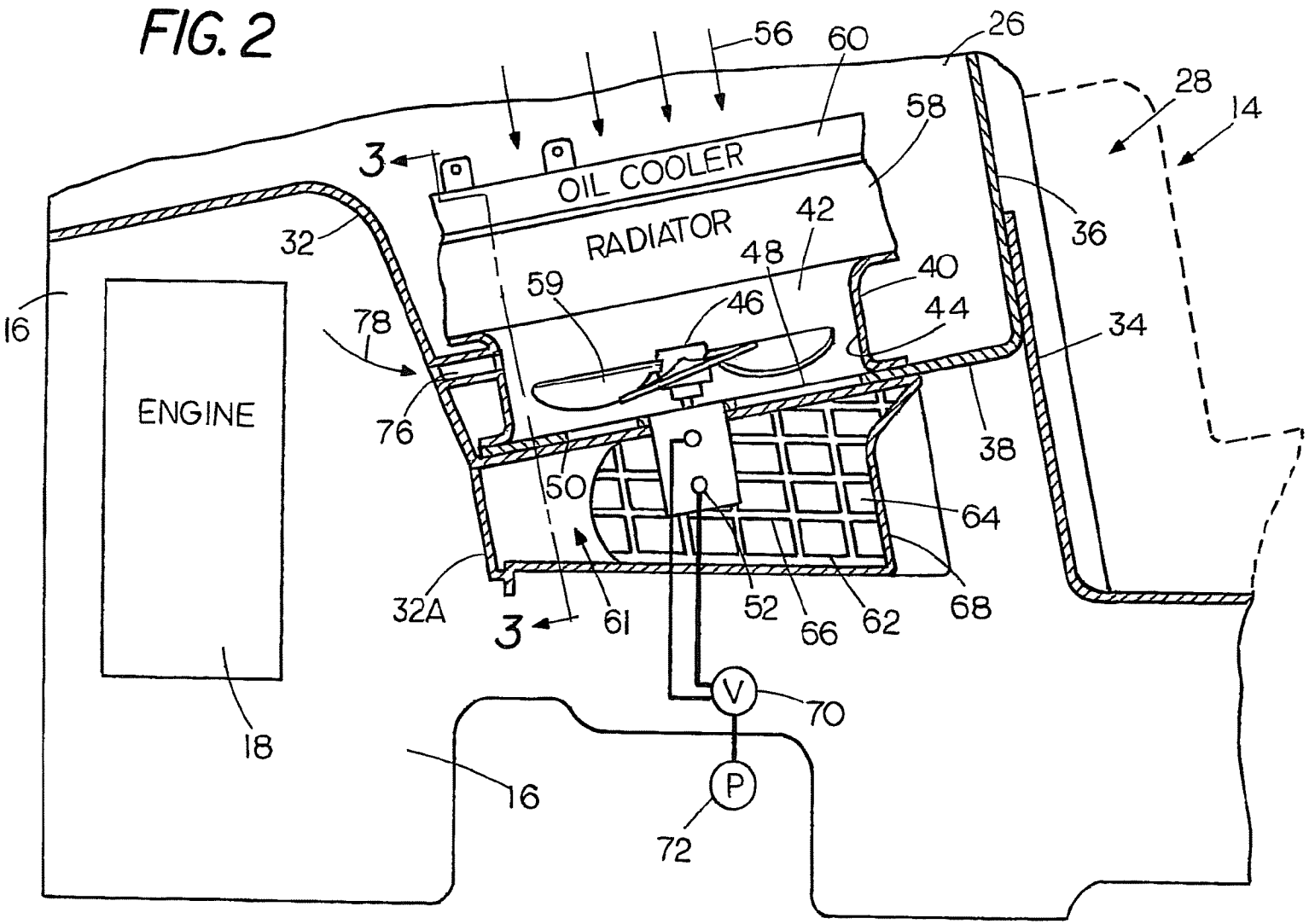
FIG. 2 is a part schematic vertical sectional view of a rear portion of the compact loader of FIG. 1, showing an air cooling system using an axial flow fan in accordance with the present disclosure.

FIG. 2 is a cross sectional view of the engine compartment 16, and a fan and cooling system compartment 26. The cooling system compartment 26 is positioned in the space between the engine compartment 16 and the operator's compartment 14, which is shown schematically in FIG. 2 as a seat 28.

The cooling system compartment 26 is separated from the engine compartment by a baffle or wall 32, at the rear of the cooling system compartment. The cooling system compartment is separated from the operator's compartment 14 with a wall 34 that is a rear wall of the operator's compartment or cab and which has an upright portion 36. A horizontal support wall 38 joins the upright wall portion 36 and the rear edge of wall 38 joins the engine compartment baffle wall 32. The cooling system includes a first fan shroud 40, which is an annular shroud, that has a first or inlet throat 42 and a second or exhaust throat 44. It should be noted that the throats form openings to the interior of the first fan shroud and are substantially the same shape, to provide smooth air flow, whether air is incoming or outgoing, through the throat. The axial flow fan assembly 46, including a motor 52, is mounted on the support wall 38, with suitable brackets 48 supporting the motor 52. It should also be noted that the support wall portion 38 has a large opening 50 through which air can flow into the first fan shroud. The fan drive motor 52 has an output shaft that rotates blades 59 of axial flow fan assembly 46. The openings formed by throats 42 and 44 face the fan assembly 46.

In a first direction of air flow, air is taken in through the upper inlet throat 42 of the cooling system compartment, as indicated by the arrows 56. An engine coolant radiator 58 is mounted on the shroud 40 at the top of the first throat opening 42. An oil cooler 60 is mounted above the radiator 58, so the air that is pulled by the fan blades 59 when the fan blades rotate in a first direction will pass through the oil cooler and the radiator before reaching the axial flow fan blades. An intercooler or charge air cooler and an air conditioning condenser can be added above the shroud 40 if they are used. The throat opening 42 is at a low pressure or negative pressure (lower than atmospheric pressure) side of the fan, and the throat 44, as shown, is on a high pressure side of the fan when the fan is rotated in a first direction. The air moved by the fan assembly 46 to the high pressure side throat 44 will be discharging air into a chamber 61 formed by a second shroud 62, that is open through the opening 50 to the first shroud 40.

The second shroud 62 has a wall that forms side discharge openings 64 that are covered with large opening grates 66. The majority of the air flow is exhausted out the open grates 66. It can be seen that the second shroud is formed so that in cross section as shown in FIG. 2, it diverges from where it joins the engine compartment baffle wall 32 to the forward wall 68 of the second shroud.

The axial fan drive motor 52 is a reversible motor, preferably, and may be a reversible electric motor, a reversible hydraulic motor or other types of motors as desired. If it is a hydraulic motor, it can operate with a suitable reversing valve 70 that is provided with hydraulic fluid under pressure from a pump 72 that is driven by the engine 18 and is part of the hydraulic pump package of the compact work vehicle or loader 10. An electric motor would have a reversing switch.

When a liquid cooled engine is being used, the air flow from the axial fan is to ensure that the engine radiator 58, the hydraulic oil cooler 60 and if provided the air conditioning condenser and charge air cooler are adequately cooled. However, in addition, one of the features of the axial flow fan is that there is a readily accessible low or negative pressure area in throat region 42, immediately above the fan blades 59, so that a duct 76 forming a port open from the throat or low pressure side 42 into the engine compartment 18 provides for an outflow of hot air from the engine compartment into the throat 42 and shroud 40, as indicated by the arrow 78.

Figure 3:
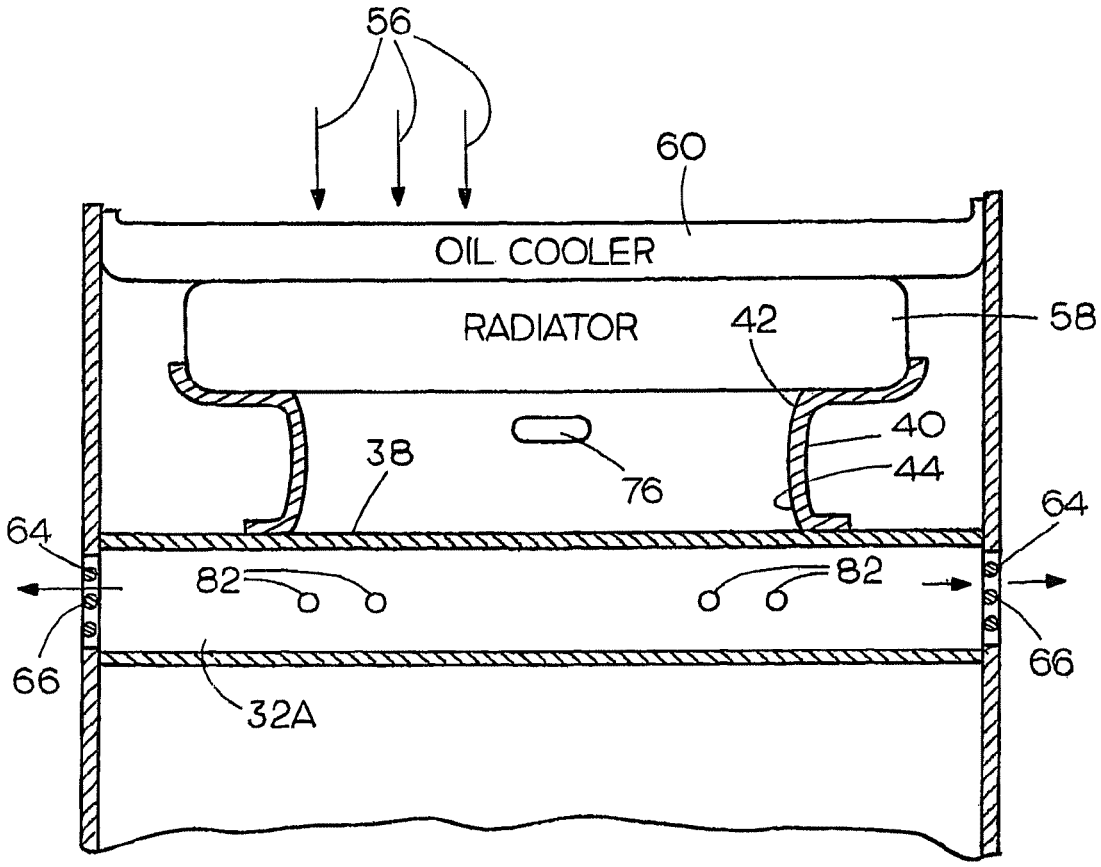
FIG. 3 is a fragmentary part schematic view taken along line 3-3 in FIG. 2.

A number of such ports or ducts 76 can be provided. In FIG. 3, a single port shown is illustrated. The ducts can vary in size, so a useful amount of hot air from the engine compartment can be pulled into the fan shroud for exhausting through the fan. Additionally, the partition or baffle wall 32 between the engine compartment 16 and the cooling system compartment 26 includes a lower wall portion 32A that closes one end of the second shroud 62. The lower wall portion 32A is provided with openings 82 (FIG. 4) to regulate flow of air from the second shroud into the engine compartment for additional cooling. The duct 76 and openings 82 form auxiliary cooling air flow openings.

The low pressure area of fan shroud 40 is easily tapped for the duct and port 76, opening directly into the engine compartment for exhausting air from the engine compartment. The second shroud 62 is formed with or adjacent the engine compartment lower baffle wall portion 32A, so openings of various sizes and locations for providing an outflow of higher pressure air from the second shroud into the engine compartment are easily provided.

It should be noted that there is a top air flow grill, that can be seen in FIG. 1, above the engine compartment.

Additionally, the axial fan assembly 46 can be reversed by reversing the drive motor 52, if desired, for drawing cool air in through the side openings 64 of the second shroud, and also drawing air in from the engine compartment through openings 82 into the second shroud 62 and then exhausting it through the radiator and oil cooler 58 and 60 and port or duct 76. This ability to reverse direction of the fan is an advantage for proper cooling related to the conditions in which the compact work vehicle is working. Reversing the fan direction of rotation can be done merely by reversing the valve 70, or if an electric motor is driving the fan blades, it can be reversed by using a reversing switch. The motor 52 is easily controlled for providing axial air flow in either direction, and providing reversible low pressure and high pressure areas in the first fan shroud. Only a single fan is needed for providing multiple air flow paths and flow direction reversibility.

Although the present invention has been described with reference to preferred embodiments, workers skilled in the art will recognize that changes may be made in form and detail without departing from the spirit and scope of the invention.

What is claimed is:

1. An air flow system for cooling components of a vehicle including a vehicle engine, the vehicle having an engine compartment and a cooling system compartment, an engine compartment wall between the engine compartment and at least portions of the cooling system compartment, a first annular shroud mounted in the cooling system compartment, a single axial flow fan positioned in the first shroud, the first shroud surrounding fan blades of the axial flow fan, and having air flow openings for air flow in an axial direction of the fan, a second shroud open to one of the air flow openings of the first shroud and the second shroud having a second shroud air flow opening carrying air flow therefrom, an engine cooling opening in the engine compartment wall open to an interior of the second shroud to permit air flow between the engine compartment and the second shroud, a flow duct extending from the engine compartment and through an opening in a portion of an annular wall in the first shroud on an opposite side of the fan from the second shroud, and a motor to drive the fan to generate air flow between the first and second shrouds and through the engine cooling opening and the flow duct.

2. The air flow system of claim 1, wherein the motor to drive the fan is a reversible motor.

3. The air flow system of claim 1, wherein said second shroud air flow opening is open to an exterior of the vehicle.

4. The air flow system of claim 1, wherein said first shroud has a first throat on one side thereof defining a first fan opening, and a second throat on an opposite side thereof defining a second fan opening, said fan being positioned in the first shroud between the first and second fan openings.

5. The air flow system of claim 1, wherein a radiator is mounted on the first shroud in a position to cause airflow to pass therethrough when the fan is rotating.

6. An axial flow cooling fan for an engine on a vehicle, a fan shroud having an annular wall surrounding said axial flow cooling fan and first and second openings on opposite ends of the fan shroud, an engine compartment on the vehicle, a duct from the engine compartment into a third opening formed into a first portion of the annular wall surrounding the axial flow fan, and a second shroud fluidly connected to the second opening of the fan shroud, said second shroud having a discharge opening to an exterior of the vehicle, and an auxiliary opening in the second shroud leading to the engine compartment and a motor to drive the axial flow fan to generate air flow between the fan shroud and second shroud and through the auxiliary opening in the second shroud and the duct.

7. The fan of claim 6, wherein said axial flow fan is reversible.

8. The fan of claim 6, wherein said axial flow fan provides the sole cooling air flow for cooling an engine in the engine compartment.

9. An engine cooling system for a compact work vehicle having an engine compartment, an engine in the engine compartment, an engine radiator, a single axial flow fan for providing cooling air for the engine and engine radiator, a fan shroud with an annular wall surrounding the axial flow fan and having an opening fluidly on one end of the annular wall open to the engine radiator on a first side of the single axial flow fan, a second shroud forming an air passageway on a second side of the single flow axial fan for carrying air flow generated by the axial flow fan, at least one air flow opening between the second shroud and the engine compartment, a duct formed in the annular wall on the first side of the single flow axial fan open to the engine compartment, and a motor connected to drive the axial flow fan to generate air flow between the fan shroud and second shroud and through the duct.

10. A method of providing cooling air to an engine in an engine compartment of a work vehicle comprising providing a single axial flow fan in an annular shroud having inlet and outlet throats, opening a duct in a portion of the annular shroud between a first of the throats and the single axial flow fan to the engine compartment, providing a second shroud open to a second of the throats, providing an opening for air flow between the second shroud and the engine compartment, and driving the single axial flow fan with a motor to generate air flow between the annular shroud and the second shroud and through duct and the opening for air flow between the second shroud and the engine compartment to.

11. The method of claim 10 wherein driving the single axial flow fan with a motor comprises further comprises driving the single axial flow fan with a reversible motor.

12. The method of claim 10 and further comprising driving the axial flow fan to form an air flow in a direction so the first throat is an air inlet to the axial flow fan.

* * * * *

UNITED STATES PATENT AND TRADEMARK OFFICE

CERTIFICATE OF CORRECTION

PATENT NO. : 8,104,559 B2
APPLICATION NO. : 12/234838
DATED : January 31, 2012
INVENTOR(S) : Brandon Kisse It is certified that error appears in the above-identified patent and that said Letters Patent is hereby corrected as shown below:

In the Specification

Column 5

Line 10, delete “compartment to” and insert --compartment--

Column 6

Line 2, delete “comprises further comprises” and insert --further comprises--

Signed and Sealed this
Twenty-second Day of October, 2013

Teresa Stanek Rea
*Deputy Director of the United States Patent and Trademark Office*